US005161963A

United States Patent [19]

Berlincourt

[11] Patent Number: 5,161,963

[45] Date of Patent: Nov. 10, 1992

[54] MULTI-BURNER GAS CONTROL APPARATUS

[75] Inventor: Don A. Berlincourt, Chagrin Falls, Ohio

[73] Assignee: Channel Products, Inc., Chesterland, Ohio

[21] Appl. No.: 724,439

[22] Filed: Jul. 1, 1991

Related U.S. Application Data

[63] Continuation of Ser. No. 402,337, Sep. 5, 1989, abandoned.

[51] Int. Cl.[5] ..... F23N 5/00

[52] U.S. Cl. ..... 431/78; 431/47; 431/25; 431/51

[58] Field of Search ..... 431/8, 25, 27, 50, 51, 431/69, 70, 71, 75, 78, 47, 48, 60

[56] References Cited

U.S. PATENT DOCUMENTS

| | | | |
|---|---|---|---|
| 2,216,534 | 10/1940 | Kirk | 431/48 |
| 2,431,158 | 11/1947 | Yates | 431/51 X |
| 3,111,160 | 11/1963 | Mellette | 431/79 |
| 3,162,430 | 12/1964 | Wilkerson | 431/27 X |
| 3,280,884 | 10/1966 | Eckelberry et al. | 431/75 X |
| 3,423,158 | 1/1969 | Forbes | 431/46 |
| 3,520,645 | 7/1970 | Cotton et al. | 431/71 X |
| 3,529,910 | 9/1970 | Potts et al. | 431/70 X |
| 3,797,988 | 3/1974 | Davidson | 431/75 X |
| 4,652,231 | 3/1987 | Berlincourt | 431/69 X |

FOREIGN PATENT DOCUMENTS

| | | |
|---|---|---|
| 4027984 | 3/1991 | Fed. Rep. of Germany . |
| 2061441 | 6/1971 | France . |
| 2142586 | 2/1973 | France . |

*Primary Examiner*—Carl D. Price
*Attorney, Agent, or Firm*—James A. Hudak

[57] ABSTRACT

Gas control apparatus to regulate the flow of gas to a plurality of burners is disclosed. The apparatus permits a main gas solenoid valve to be actuated for a pre-determined period of time allowing the burners to be ignited. If the burners are not ignited within the pre-determined period of time, the main gas solenoid valve is deactuated. Even though a main gas solenoid valve is utilized, each burner can be separately ignited by means of a start signal applied thereto. After ignition, the main gas solenoid valve will remain actuated only if a flame is present at the ignited burner and a start signal is applied to the remaining burners.

3 Claims, 5 Drawing Sheets

MULTI-BURNER GAS CONTROL APPARATUS

This is a continuation of copending application Ser. No. 07/402,337 filed on Sep. 5, 1989 now abandoned.

TECHNICAL FIELD

The present invention relates, in general, to gas control apparatus for a multi-burner application and, more particularly, to gas control apparatus which includes a main gas solenoid valve to control the flow of gas to a plurality of burners.

BACKGROUND ART

In certain gas burner applications, it is desirable to be able to control the flow of gas to a plurality of isolated or spaced-apart burners associated with the single appliance or furnace. Such control is typically accomplished by providing a complete gas control arrangement for each burner within the plurality of burners. With such burner installations, only relatively minor cost reductions have been realized by combining gas controls using a common power supply and hardware components. Such prior art controls require a separate gas solenoid valve to regulate the flow of gas to each burner and a separate relay to control the operation of each gas solenoid valve. Thus, there is a duplication of equipment since each burner requires its own gas solenoid valve and associated relay.

In view of the foregoing, it has become desirable to develop gas control apparatus which requires the use of only a main gas solenoid valve to regulate the flow of gas to a plurality of burners.

SUMMARY OF THE INVENTION

The present invention solves the problems associated with the prior art and other problems by providing apparatus that controls the operation of a main gas solenoid valve to regulate the flow of gas to a plurality of burners. In one embodiment of the present invention, after the expiration of a pre-determined period of time, the main gas solenoid valve is actuated allowing the flow of gas to each burner within the plurality of burners. If the gas is not ignited at each burner within a certain period of time, then the main gas solenoid valve is deactuated. However, if the gas is ignited at each of the burners during the foregoing period of time, flame sensors are actuated causing the main gas solenoid valve to remain actuated permitting the flow of gas to each burner within the plurality of burners. In an alternate embodiment of the present invention, each burner is provided with its own manual gas valve and associated switch, and the main gas solenoid valve controls the flow of gas to the manual gas valve associated with each burner. A start signal is provided to the control circuitry associated with each burner, however, actuation of the main gas solenoid valve will occur only if at least one switch associated with a manual gas valve for a burner has been actuated. In addition, the main gas solenoid valve will remain actuated only if the control circuitry associated with each of the burners has either a start signal applied thereto or a flame signal is present at the burner. A similar procedure for the establishment of a flame within a certain period of time, as in the previous embodiment, is also required in this latter embodiment of the present invention.

DESCRIPTION OF THE PREFERRED EMBODIMENT

Figure 1:
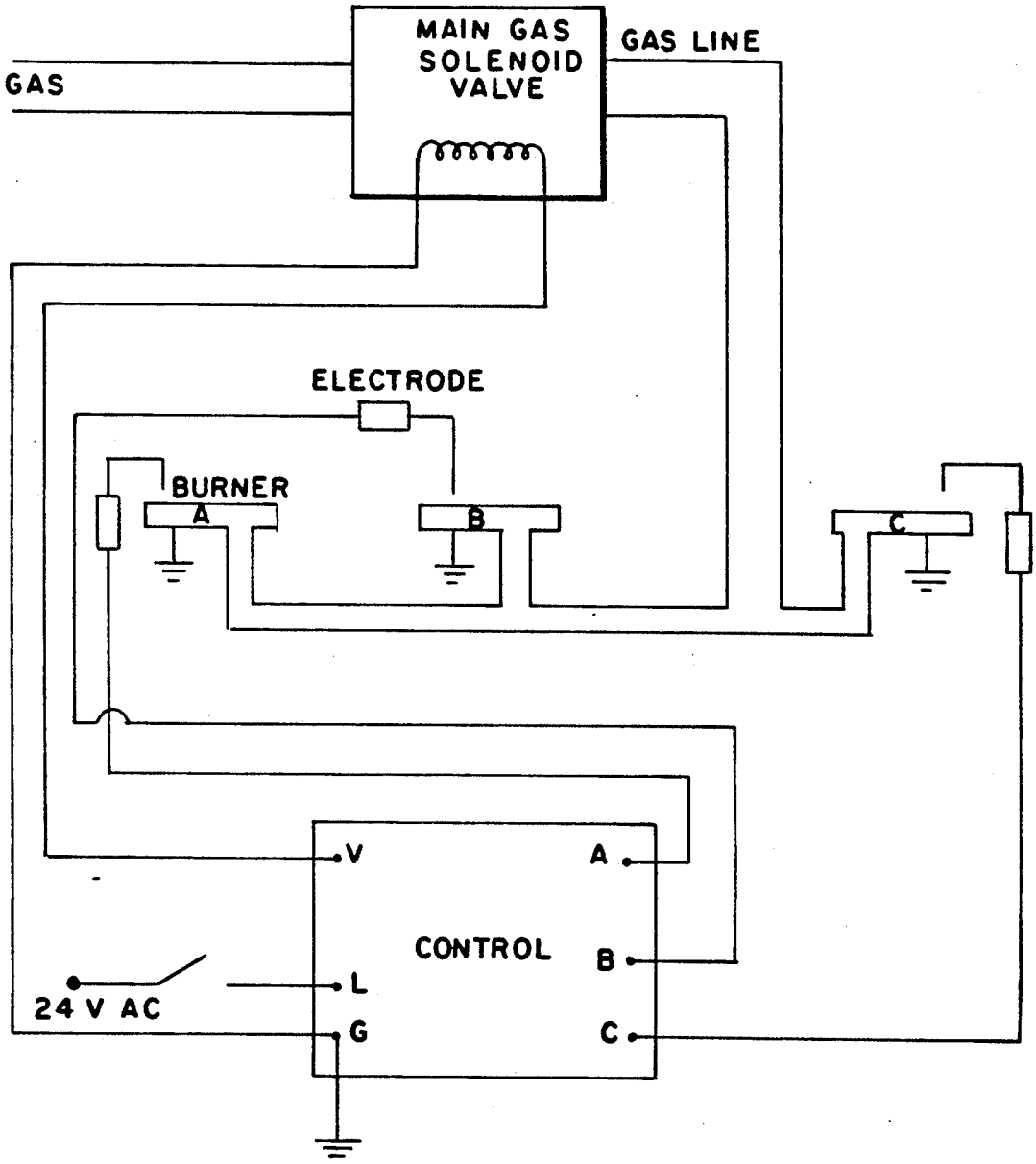
FIG. 1 is a schematic diagram of an embodiment of the present invention wherein a main gas solenoid valve controls the flow of gas to a plurality of burners.
Figure 2:
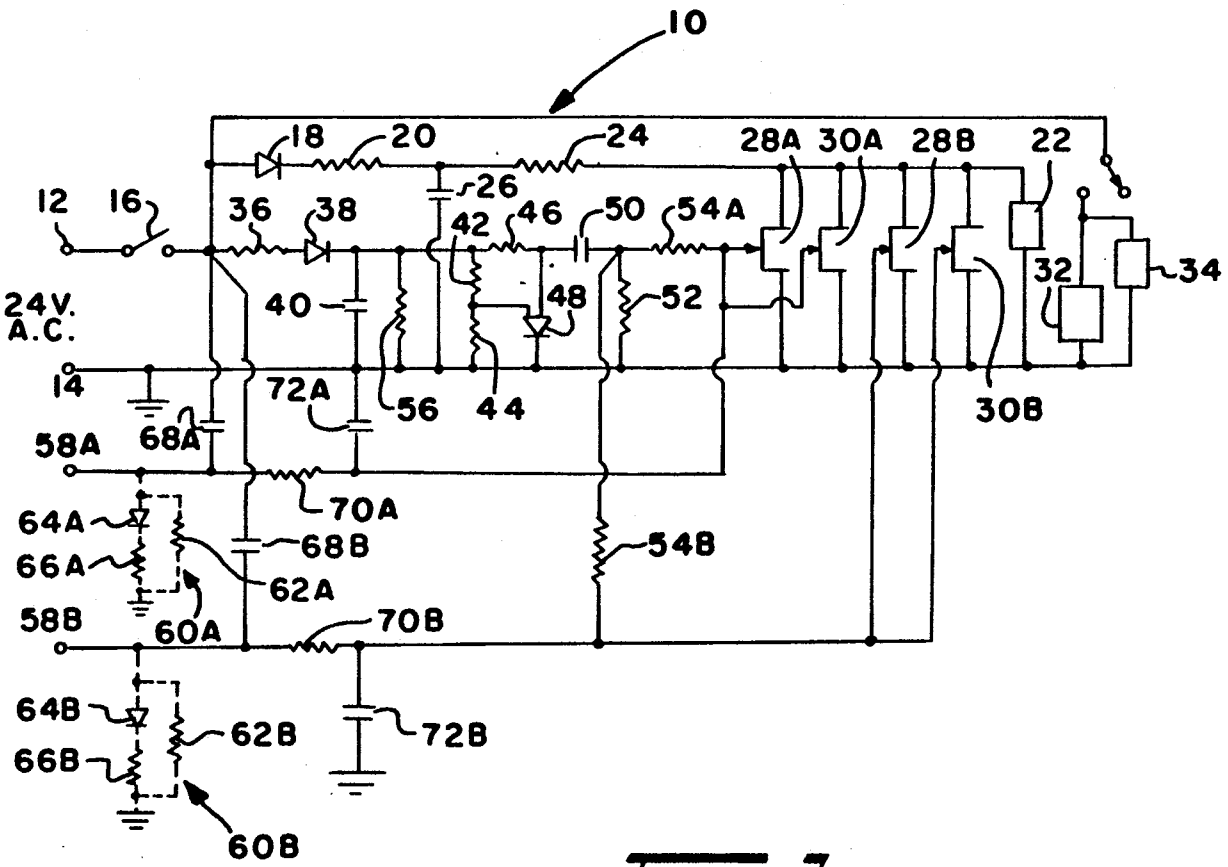
FIG. 2 is a schematic diagram of the electrical circuit utilized by the apparatus illustrated in FIG. 1.

Referring now to the drawings, where the illustrations are for the purpose of describing the preferred embodiment of the present invention and are not intended to limit the invention hereto, FIG. 1 is a schematic diagram of gas control apparatus utilizing a main gas solenoid valve to control the flow of gas to burners A, B, C, etc. Each burner has an igniter and a flame sensing element associated therewith. Regardless of the type of igniter utilized, the igniter can act as the flame sensor or a separate flame sensing element can be employed. FIG. 2 is a schematic diagram of an electrical circuit 10 utilized by the gas control apparatus illustrated in FIG. 1. The circuit 10 is provided power by a 24 volt AC power supply connected to its input terminals 12 and 14. Terminal 14 is connected to ground potential. The circuit 10 includes a thermostat 16 which interconnects input terminal 12 to a half-wave rectifier comprising a diode 18 and a resistor 20 which supplies power to the coil of a relay 22 via resistor 24. A ripple smoothing capacitor 26 is connected to the junction of resistors 20 and 24 and to ground potential. Field-effect transistors 28A, 30A, 28B, 30B, etc., a pair for each burner, are connected in parallel with the relay 22 and control the operation of same, as hereinafter described. A common contact associated with the relay is connected to the input terminal 12 through thermostat 16 and, upon actuation of the relay 22, connects a main gas solenoid valve 32 across the input terminals 12 and 14. The main gas solenoid valve 32 controls the flow of gas to each burner within the plurality of burners. An electronic spark device 34 is connected in parallel with the main gas solenoid valve 32 and is typically actuated when the main gas solenoid valve 32 is actuated. Alternatively, a heater type igniter (not shown), such as a silicon carbide igniter, along with additional circuitry known and practiced in the art, can be used in place of the electronic spark device 34 for igniting the gas.

Half-wave rectified DC power is similarly provided by a resistor 36 and a diode 38 which interconnects input terminal 12 to a timing circuit comprising a capacitor 40; resistors 42, 44, 46, 56; programmable unijunction transistor 48; capacitor 50; and resistors 52, 54A, arranged and interconnected as shown. The resistance of each of the resistors 54A, 54B is at least about ten times greater than the resistance of resistor 52. Resistor 54A is connected to the gates of field-effect transistors 28A and 30A and resistor 54B is connected to the gates of field-effect transistors 28B and 30B. For additional burners C, D, etc., field-effect transistors 28C, 30C, and 28D, 30D, etc. and resistors 54C, 54D, etc., (all not shown) are respectively provided for same. The resistor 36 and resistor 44 "set" the voltage for the timing circuit.

An input terminal 58A is connected to a conducting probe or flame electrode which is immersed in the flame of one of the plurality of burners, i.e., burner A. The equivalent electrical circuit of the flame is shown generally by the numeral 60A and is comprised of a resistor 62A connected in parallel with a series combination of a diode 64A and another resistor 66A. The foregoing equivalent electrical circuit of the flame is connected between the input terminal 58A and ground potential and represents the flame when established. A capacitor 68A is connected to one of the contacts of the thermostat 16 and to input terminal 58A. The input terminal 58A is connected to the gates of field-effect transistors 28A and 30A via a resistor 70A which is also connected to input terminal 14 via a capacitor 72A. Each additional burner within the system is similarly provided with a conducting probe or flame electrode which is immersed in its respective burner flame and is connected to its respective input terminal 58B, 58C, etc. Similarly, resistors 70B, 70C, etc.,; resistors 54B, 54C, etc.; capacitors 68B, 68C, etc; and capacitors 72B, 72C, etc. are provided for additional burners B, C, etc., respectively. Furthermore, as previously indicated, each additional burner in the system has its own set of field-effect transistors 28B, 28C, etc. and 30B, 30C, etc. for burners B, C, etc., respectively.

The electrical circuit 10 operates in the following manner. When the thermostat 16 "calls" for heat, its contacts close causing half-wave rectified DC power to be applied to the timing circuit via the resistor 36 and the diode 38. The field-effect transistors 28A, 30A, 28B, 30B, 28C, 30C, etc. provide a very low resistance path between their terminals (hereinafter referred to as the turn "on"condition) if a negative voltage insufficient to actuate same is applied to their respective gates. This very low resistance path results in the application of a voltage to the coil of relay 22 insufficient to actuate same. The application of a negative voltage to the gates of the field-effect transistors sufficient to actuate same causes these transistors to provide a very high resistance path between their terminals (hereinafter referred to as the turn "off"condition) resulting in the application of a voltage to the coil of relay 22 sufficient to actuate same. The application of the half-wave rectified DC power to the timing circuit causes the capacitor 40 to charge through resistor 36. Such charging typically requires less than one second. The resistor 56 acts to limit the voltage on the capacitor 40 to a desired predetermined level. The resistors 42 and 44 act as a voltage divider to bias the gate of the programmable unijunction transistor 48. Typical resistance values for the resistors 42 and 44 are such so as to "set" the operation of the gate of the transistor 48 at a predetermined voltage, such as approximately 22 volts. Thus, the transistor 48 remains unactuated until the capacitor 50 is nearly fully charged through the resistors 46 and 52. The values for the capacitor 50 and the resistors 46 and 52 may be chosen so that the charging time for the capacitor 50 is relatively long, e.g., 35 to 40 seconds for the anode voltage of the transistor 48 to exceed its gate voltage. When the voltage at the anode of the transistor 48 exceeds its gate voltage, the transistor 48 turns "on", effectively grounding the positive plate of the capacitor 50, e.g., the plate connected to the anode of the transistor 48. This grounding action causes the capacitor 50 to apply a sufficiently negative voltage to the gates of the field-effect transistors 28A, 30A, 28B, 30B, 28C, 30C, etc. through resistors 54A, 54B, 54C, etc., respectively, turning these transistors "off". The extinguishing of all of these transistors 28A, 30A, 28B, 30B, 28C, 30C causes the relay 22 to become actuated which, in turn, causes the main gas solenoid valve 32 and the electronic spark device 34 to become actuated. In this manner, gas is permitted to flow to each of the burners and is ignited by the electronic spark device 34. As soon as the transistor 48 turns "on", the capacitor 50 begins to discharge through the transistor 48 and the resistor 52. The discharge time may take approximately 5 seconds, for example, to reduce the voltage at the gates of the field-effect transistors 28A, 30A, 28B, 30B, 28C, 30C, etc. to a level at which the foregoing transistors may again turn "on". During this time the gas continues to flow to each of the burners in the system and sparking continues. If the gas is not ignited at each of the burners during this 5 second ignition period, then the field-effect transistors 28A, 30A, 28B, 30B, 28C, 30C, etc. again turn "on" which causes the deactuation of relay 22, main gas solenoid valve 32 and electronic spark device 34. It should be noted that the electronic spark device 34 stops sparking when a flame is present at each of the burners in the system even though the spark device 34 is still actuated.

If the gas is ignited at each of the burners during the foregoing 5 second ignition period, the flame at each of the burners acts as a low quality diode, shown schematically as diode 64A, 64B, 64C, etc. and resistors 62A, 62B, 62C, etc., 66A, 66B, 66C, etc. from input terminal 58A, 58B, 58C, etc., respectively, to ground potential. This action as a diode causes the ungrounded plate of each of the capacitors 72A, 72B, 72C, etc. to be charged negatively with respect to its grounded plate. This charging action ensures that the field-effect transistors 28A, 30A, 28B, 30B, 28C, 30C, etc. remain turned "off" when there is a flame at each of the burners even though the capacitor 50 becomes discharged. Thus, the main gas solenoid valve 32 remains actuated permitting gas to flow to each of the burners in the system but the electronic spark device 34 does not spark because of the existence of a flame on its spark electrode. The electrical circuit 10 remains in this state as long as the thermostat 16 is "calling" for heat. If the contacts associated with the thermostat 16 open, upon their reclosure, the foregoing ignition sequence is recommenced.

If there is an interruption in the flow of gas to one of the burners causing the flame to be extinguished or if a gust of wind extinguishes the flame at one of the burners, relay 22 remains actuated and the electronic spark device 34 immediately starts sparking. When the flame is extinguished at one of the burners, the capacitor 72A, 72B, 72C, etc., associated with that burner begins to discharge through the resistors 54A, 54B, 54C, etc., respectively, and resistor 52. This discharge time may be set, for example, at approximately 5 seconds for the respective capacitor 72A, 72B, 72C, etc. to be discharged to the point where its associated field-effect transistors 28A, 30A, 28B, 30B, 28C, 30C, etc. are turned "on". During this 5 second period, the relay 22 remains actuated. If ignition is accomplished during this 5 second period, the capacitor 72A, 72B, 72C, etc. associated with the newly ignited burner is recharged and the relay 22 remains actuated. If ignition is not achieved during this period, the field-effect transistors 28A, 30A, 28B, 30B, 28C, 30C, etc. associated with the extinguished burner turn "on" causing the relay 22 to become deactuated which, in turn, deactuates the electronic spark device 34 and the main gas solenoid valve 32 stopping the flow of gas to the burners. In any event, it should be noted that adjustments of circuit parameters readily allow for a wide range of timings to be achieved.

Figure 3:
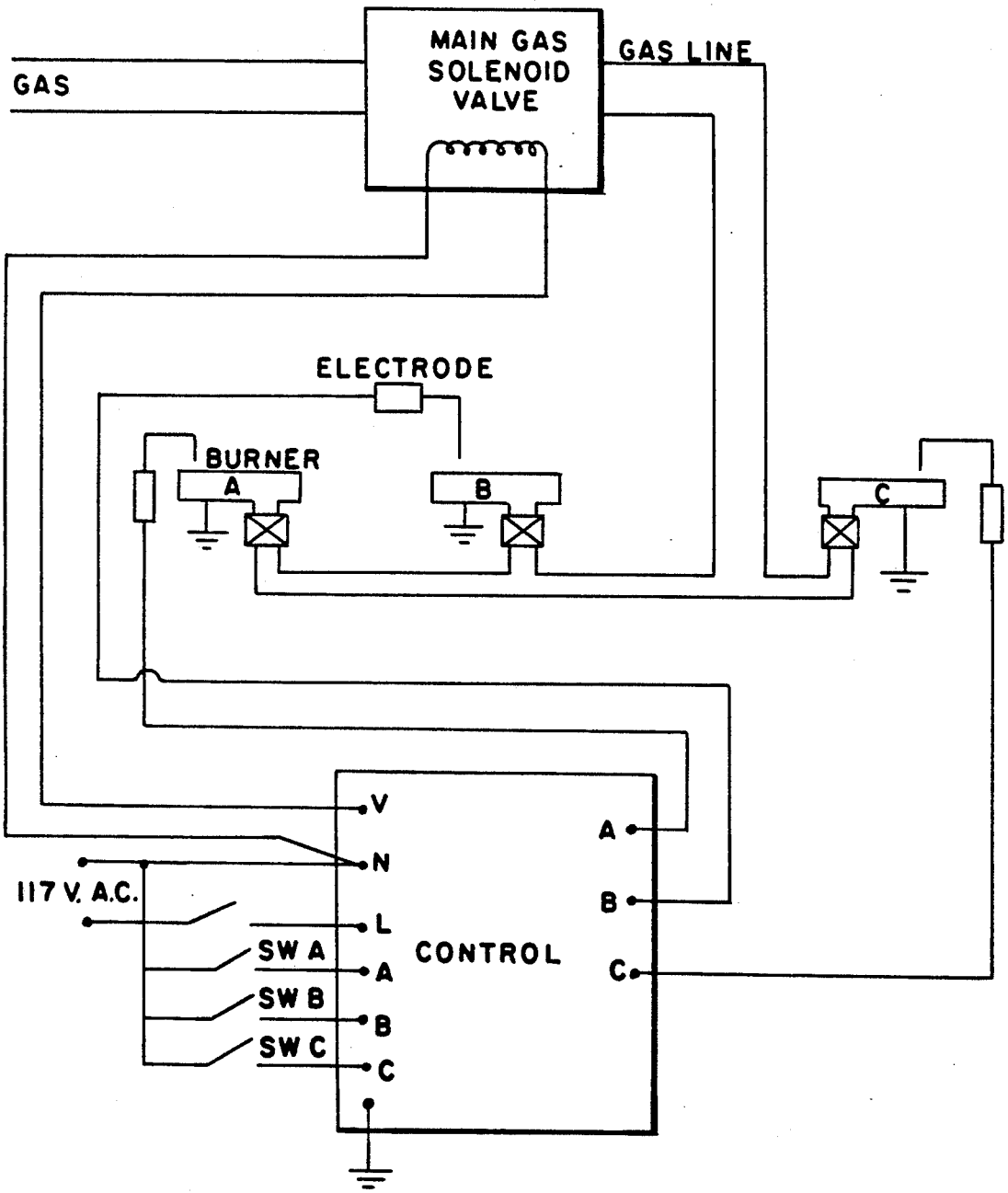
FIG. 3 is a schematic diagram of another embodiment of the present invention wherein a main gas solenoid valve controls the flow of gas to a plurality of burners, each burner having a manual gas valve and switch associated therewith.
Figure 4:
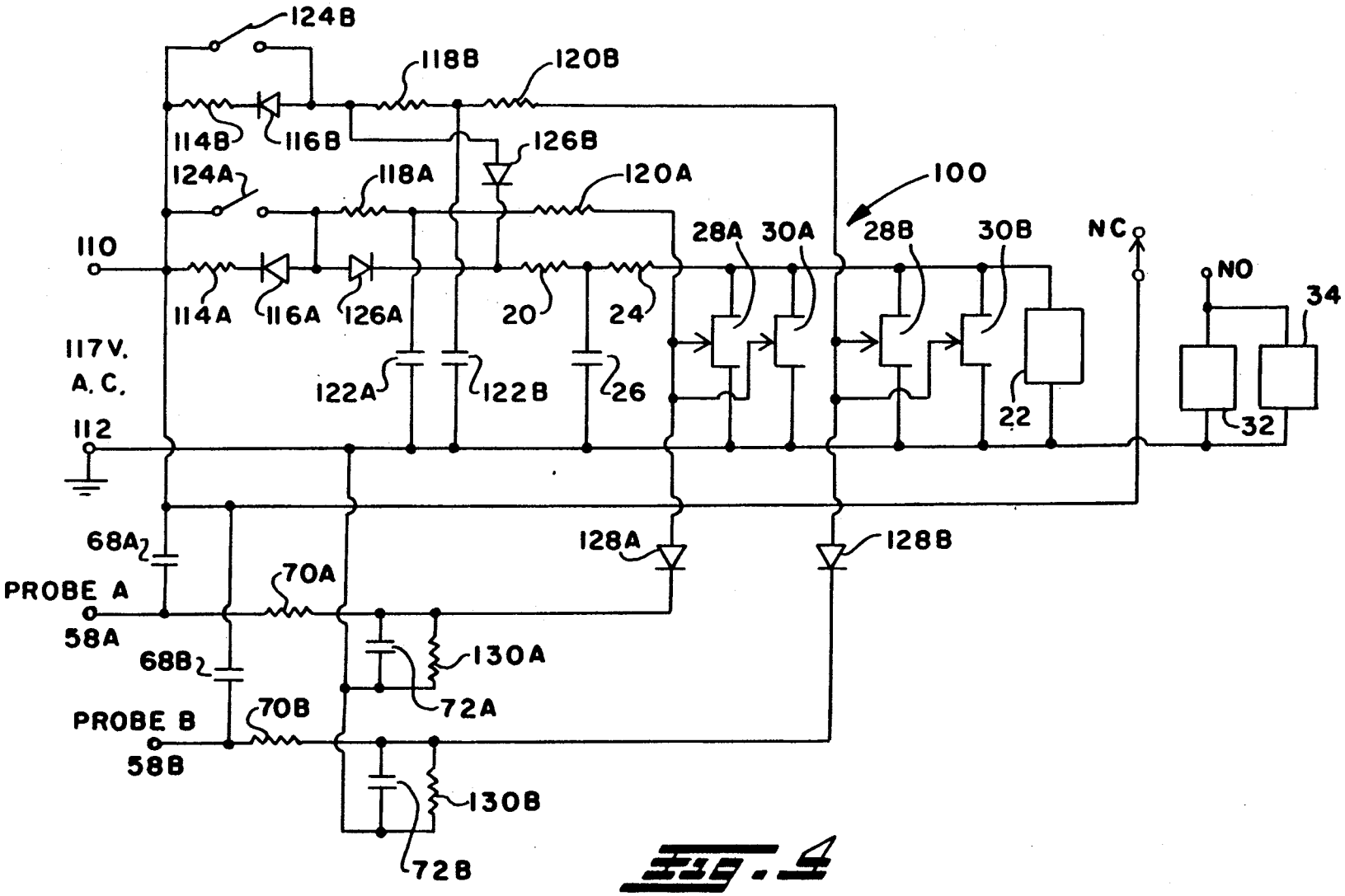
FIG. 4 is a schematic diagram of the electrical circuit utilized by the embodiment of the present invention illustrated in FIG. 3.

An alternate embodiment of the present invention is shown in FIG. 3 which is a schematic diagram of gas control apparatus utilizing a main gas solenoid valve to control the flow of gas to burners A, B, C, etc.; each burner also having a separate manual gas valve and switching means associated therewith. Here again, each burner has an associated igniter and flame sensing element or the igniter can act as the flame sensor. FIG. 4 is a schematic diagram of an electrical circuit 200 utilized by the gas control apparatus illustrated in FIG. 3. Those components which are similar to the components in FIG. 2 carry like reference numerals. Electrical circuit 100 is provided power by a 117 volt AC power supply connected to its input terminals 110 and 112. Terminal 112 is connected to ground potential. There are approaches that are well known in the art to prevent problems if ground and neutral are reversed with the 117 Volts AC, and thus such approaches will not be discussed herein. The electrical circuit 100 includes a start circuit comprising a resistor 114A, a diode 116A, resistors 118A and 120A and a capacitor 122A. Resistor 114A and diode 116A provide half-wave rectified power with voltage negative for the start circuit. A capacitor 122A is connected between the junction of resistor 118A and resistor 120A and input terminal 112.

The power portion of electrical circuit 100 is comprised of a switch 124A and a diode 126A. The contacts associated with switch 124A are connected between input terminal 110 and the junction between diode 116A and a diode 126A, which are connected in a back-to-back relationship. Diode 126A and resistor 20 provide half-wave rectified power via resistor 24 to field-effect transistors 28A and 30A and to the coil of relay 22. The common contact associated with relay 22 connects the input terminal 110 to the main gas solenoid valve 32 and to the electronic spark generator 34 when the relay is operated. A diode 128A is connected between the gates of field-effect transistors 28A, 30A and capacitor 72A which is shunted by a resistor 130A. The diode 238A isolates the start circuit comprised of resistor 114A, diode 116A, resistors 118A and 120A and capacitor 122A from the circuit for the flame probe, i.e., resistors 70A, 130A and capacitors 68A, 72A, which is connected to input terminal 58A. Each burner in the system is provided with its own start circuit, power circuit and circuit for its respective flame probe. For example, burner B has its own start circuit comprised of resistor 114B, diode 116B, resistors 118B and 120B and capacitor 122B connected such as to provide half-wave rectified power to field-effect transistors 28B and 30B; a power circuit comprised of switch 124B and diode 126B; and a circuit for the flame probe for burner B, i.e., resistors 70B, 130B and capacitors 68B, 72B. The start circuit for burner B is isolated from the circuit for the flame probe for burner B by means of a diode 128B connected between the gates of field-effect transistors 28B, 30B and the foregoing flame probe circuit for burner B.

The operation of electrical circuit 100 is similar to that of electrical circuit 10, however, there are some distinct differences. With all switches 124A, 124B, 124C, etc. open, a negative DC voltage is applied to the gates of field-effect transistors 28A, 30A, 28B, 30B, 28C, 30C, etc. and to capacitors 122A, 122B, 122C, etc. associated therewith via resistors 114A, 114B, 114C, etc., 118A, 118B, 118C, etc. and diodes 116A, 116B, 116C, etc., respectively. Each of the foregoing switches is coupled mechanically to a manual gas valve so that actuation of the valve closes the switch. Gas is allowed to flow only to the burner whose manual gas valve has been actuated after the main gas solenoid valve 32 has been actuated. The application of the foregoing negative DC voltage to the field-effect transistors causes each of the transistors to turn "off". When one of the switches 124A, 124B, 124C, etc. is subsequently closed, rectified DC power is applied via its associated diode 126A, 126B, 126C, etc. and resistors 20, 24 to relay 22 causing the relay 22 and the main gas solenoid valve 32 to become actuated. The capacitor 122A, 122B, 122C, etc. associated with the switch 124A, 124B, 124C, etc. that was closed begins to discharge through resistor 118A, 118B, 118C, etc. and the low impedance of the input power source via input terminal 110. When the voltage at the ungrounded plate of the discharging capacitor 122A, 122B, 122C, etc. drops below the value required to keep its associated field-effect transistors 28A, 30A, 28B, 30B, 28C, 30C, etc. turned "off", the relay 22 and the main gas solenoid valve 32 become deactuated. Thus, unless a flame signal is established during the initial trial period so as to charge associated capacitors 72A, 72B, 72C, etc., the relay 22 and the main gas solenoid valve 32 will become deactuated. In summary, with respect to those burners having an associated switch 124A, 124B, 124C, etc. that is open, a start signal is provided by its associated start circuit to its respective field-effect transistors 28A, 30A, 28B, 30B, 28C, 30C, etc., however, the main gas solenoid valve 32 will open only if at least one switch 124A, 124B, 124C, is closed. In addition, the main gas solenoid valve 32 will remain open only if all of the field-effect transistors 28A, 30A, 28B, 30B, 28C, 30C, etc. have either a start signal applied thereto or a flame signal at their respective flame probes.

Figure 5:
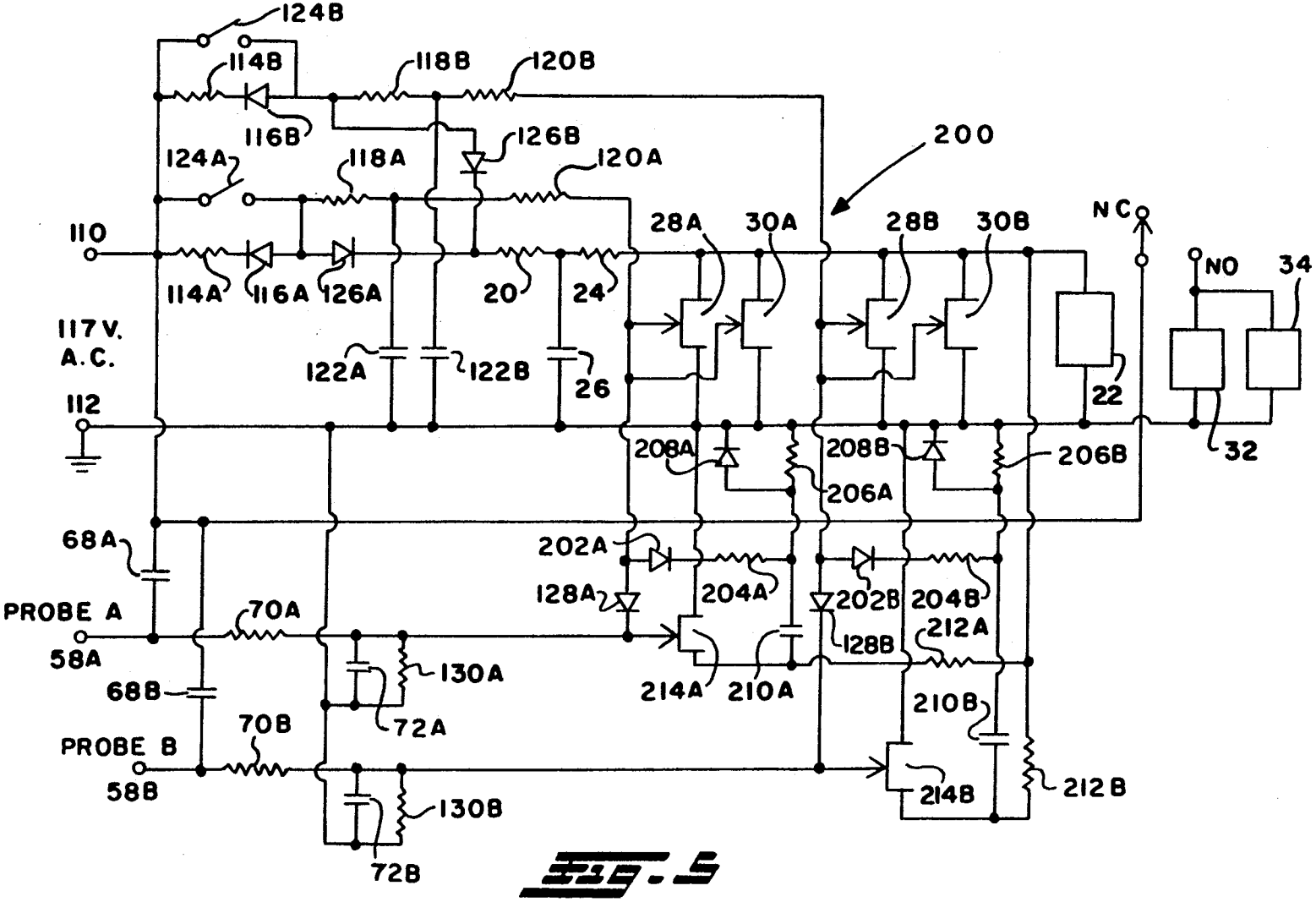
FIG. 5 is a schematic diagram of the electrical circuit utilized by another embodiment of the present invention.

Still another alternate embodiment of the present invention is shown in FIG. 5 which is a schematic diagram of an electrical circuit 200 which operates in a manner similar to electrical circuit 100 illustrated in FIG. 4. Those components which are similar to the components in FIG. 4 carry like reference numerals. The electrical circuit 200 differs from electrical circuit 100 in that it includes a diode 202A and resistors 204A, 206A connected in series between the gates of field-effect transistors 28A, 30A and input terminal 112. A diode 208A is connected in parallel with resistor 206A. A capacitor 210A and a resistor 212A are connected in series between the junction of resistors 204A and 206A and the ungrounded side of relay 22. A field-effect transistor 214A is connected between input trminal 112 and the junction of capacitor 210A and resistor 212A. The gate of field-effect transistors 214A is connected to the cathode of diode 128A. A similar circuit configuration is provided for burners B, C, etc. and the components carry the appropriate suffix B, C, etc., respectively.

Operationally, assume that switches 124A and 124B are closed and that flame is present at burners A and B. In this case, flame rectification causes capacitors 72A and 72B to be charged negatively with respect to ground potential and this negative voltage is applied to the gates of field-effect transistors 28A, 30A, 28B, 30B through diode 128A, 128B, respectively. Diodes 202A and 202B allow current to flow to capacitors 210A and 210B, respectively, charging same. The voltage applied to the gates of field-effect transistors 28A and 30A is also applied to capacitor 122A charging same through resistor 120A while the voltage applied to the gates of field-effect transistors 28B and 30B is applied to capacitor 122B charging same through resistor 120B. In addition, the voltages existing at capacitors 72A, 72B are applied to the gates of field-effect transistors 214A, 214B, respectively, turning both of these transistors "off". This action allows capacitor 210A to be charged through resistor 212A and diode 208A to a positive voltage which is approximately equal to that existing at the coil of relay 22. Capacitor 210B is similarly charged through resistor 212B and diode 208B to a positive voltage approximately equal to that existing at the coil of relay 22. In this condition, if the flame at burner A is extinguished due to a draft or some other cause, capacitor 72A will rapidly discharge through resistors 130A causing field-effect transistor 214A to turn "on". Resistor and capacitor values are pre-determined so that capacitor 122A remains charged for a longer period of time than capacitor 72A causing field-effect transistors 28A and 30A to remain turned "off" resulting in the main gas solenoid valve 32 remaining open for a period of time. The positive plate of capacitor 210A is grounded through the low resistance of field-effect transistor 214A, which has been turn "on", causing the other plate of capacitor 210A to be at a negative potential. This negative potential is applied to the gates of field-effect transistors 28A and 30A keeping these transistors turned "off". The voltage on capacitor 210A decays through resistor 206A to ground potential. After a pre-determined period of time, for example, five seconds, the voltage on capacitor 210A has decayed to the point where it is insufficient to keep field-effect transistors 28A and 30A turned "off" unless a flame has been re-established at burner A. If a flame has been re-established, gas flow will be maintained. If the flame has not been re-established within the foregoing pre-determined period of time, field-effect transistors 28A and 30A turn "on" causing deactuation of relay 22 and the main gas solenoid valve 32 stopping the flow of gas to all burners.

Certain modifications and improvements will occur to those skilled in the art upon reading the foregoing. It should be understood that all such modifications and improvements have been deleted herein for the sake of conciseness and readability, but are properly within the scope of the following claims.

I claim:

1. A system for controlling the operation of a valve which regulates the flow of fuel to a plurality of burners comprising:

relay means responsive to the application of power thereto, said relay means controlling the operation of the valve;

means for detecting the presence of a flame at each burner within the plurality of burners; and means for controlling the application of power to said relay means, said controlling means comprising timing means and a plurality of switching means, each switching means within said plurality of switching means being associated with a burner within said plurality of burners, said timing means cooperating with said each switching means within said plurality of switching means preventing the application of sufficient power to said relay means to actuate said relay means and the valve for a first pre-determined period of time and allowing sufficient power to be applied to said relay means actuating said relay means and the valve for a second pre-determined period of time, said timing means cooperating with said each switching means within said plurality of switching means preventing the continued application of sufficient power to said relay means after the expiration of said second pre-determined period of time unless said detecting means determines that a flame is present at each burner within said plurality of burners.

2. The system as defined in claim 1 further including means for igniting the fuel emanating from each burner within the plurality of burners.

3. The system as defined in claim 2 wherein said igniting means comprises a spark generating device.

* * * * *